US005600865A

United States Patent [19]

Morrison

[11] Patent Number: 5,600,865

[45] Date of Patent: Feb. 11, 1997

[54] HAIR BRUSH WITH ATTACHED CLEANING FEATURE

[76] Inventor: Mark D. Morrison, 666 W. End Ave., Apt. 19J, New York, N.Y. 10025

[21] Appl. No.: 541,145

[22] Filed: Oct. 11, 1995

[51] Int. Cl.[6] ..... A46B 17/06

[52] U.S. Cl. ..... 15/169; 15/160; 15/246; 119/628; 132/119

[58] Field of Search ..... 15/159.1, 160, 15/169, 184, 246; 132/119; 119/628

[56] References Cited

U.S. PATENT DOCUMENTS

| | | | |
|---|---|---|---|
| 717,377 | 12/1902 | Flanders | 119/88 |
| 1,050,103 | 1/1913 | Clemens . | |
| 1,164,204 | 12/1915 | Mullett et al. . | |
| 1,290,554 | 1/1919 | Healey . | |
| 1,303,500 | 5/1919 | Rosenberg . | |
| 2,529,927 | 11/1950 | Fisk . | |
| 2,916,756 | 12/1959 | Peilet et al. | 15/184 |
| 3,108,305 | 10/1963 | Peilet | 15/169 |
| 3,110,053 | 11/1963 | Surabian | 15/169 |
| 4,517,703 | 5/1985 | Koke | 119/88 |
| 4,932,425 | 6/1990 | Chen | 132/119 |

FOREIGN PATENT DOCUMENTS

| | | | |
|---|---|---|---|
| 289465 | 11/1988 | European Pat. Off. | 15/160 |
| 471561 | 11/1914 | France | 132/119 |
| 2021729 | 11/1971 | Germany | 15/184 |
| 13917 | 10/1887 | United Kingdom | 132/119 |
| 794594 | 5/1958 | United Kingdom | 15/184 |

*Primary Examiner*—Mark Spisich

*Attorney, Agent, or Firm*—Hayes, Soloway, Hennessey, Grossman & Hage, P.C.

[57] ABSTRACT

A hair brush having a cleaning feature which can be releasably attached to the brush comprising a base section having a multiplicity of parallel bristles extending from a bristle-holding surface thereof, a cleaning plate disposed on the bristle-holding surface and having holes through which the parallel bristles extend, the cleaning plate containing a hand-operated mechanism for releasably engaging the cleaning plate from the hair brush to remove the cleaning plate for cleaning purposes.

4 Claims, 1 Drawing Sheet

HAIR BRUSH WITH ATTACHED CLEANING FEATURE

BACKGROUND OF THE INVENTION

The present invention relates to a hair brush of the type having a cleaning plate slidably movable along the bristles thereof for the purposes of removing hair therefrom characterized in that said cleaning plate contains a hand-operated engaging means for releasably engaging said cleaning plate from said brush.

Hair brushes containing a cleaning feature for use on both humans and animals are known in the art. Such brushes are exemplified by the following U.S. Pat. Nos. 1,050,103; 1,164,204; 1,290,554; 1,303,500; 2,529,927; 3,108,305; 3,110,053; and 4,517,703.

Such prior art arrangements, however, are relatively complex and costly to manufacture. In addition, such arrangements significantly lack the important convenience of releasbly maintaining a slidably mounted cleaning member in an attached configuration to the brush, so that it remains intact and simultaneously provides for ease of use in the cleaning operation.

Accordingly, it is an object of the present invention to provide an improved hair brush having a cleaning feature which can be attached and removed from the brush by a hand-operated engaging means, employing a relatively simple and reliable construction.

In addition, it is a more specific object of the present invention to provide an improved hair brush having the aforementioned cleaning feature, further characterized in that the cleaning feature contains a finger-operated lift-off tab that makes it easy for the user to lift said cleaning feature on and off the brush.

SUMMARY OF THE INVENTION

A hair brush having a cleaning feature which can he releasably attached to the brush comprising a base having a multiplicity of parallel bristles extending from a bristle-holding surface thereof, a cleaning plate disposed on said bristle-holding surface and having holes through which the parallel bristles extend, said cleaning plate containing a hand-operated means for releasably engaging said cleaning plate from said hair brush to remove said cleaning plate for cleaning purposes.

DETAILED DESCRIPTION OF PREFERRED EMBODIMENTS

Figure 1:
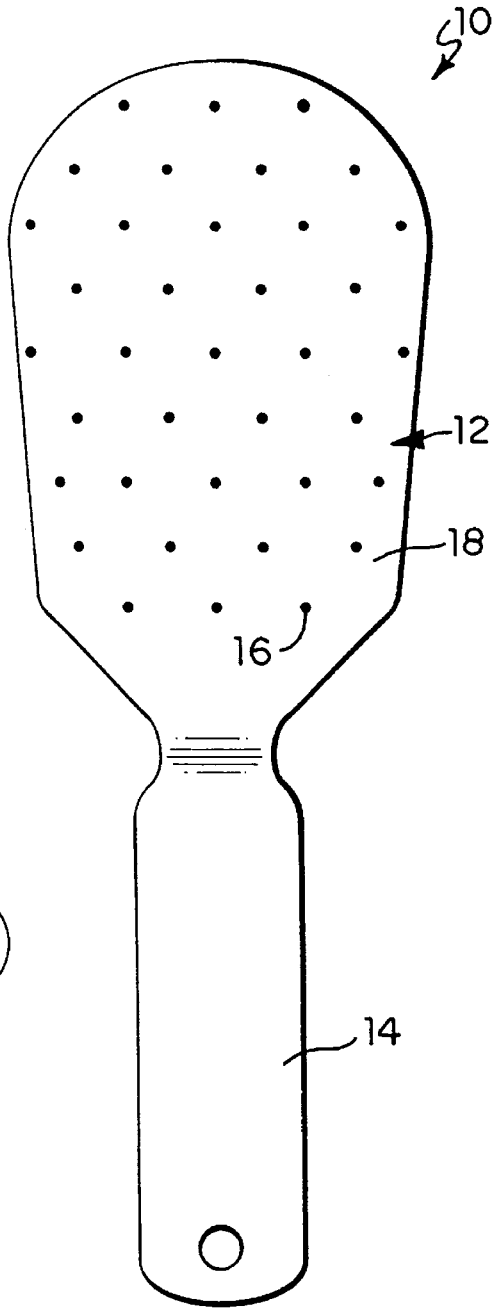
FIG. 1 is an exploded view of a hair brush according to the present invention, depicting the rear of the brush.

With reference to FIG. 1, the hairbrush is shown generally at 10, and contains base 12 and handle 14. A multitude of bristles 16 extend from the bristle holding surface 18, one end of each of the bristles 16 being embedded in base 12.

Figure 2:
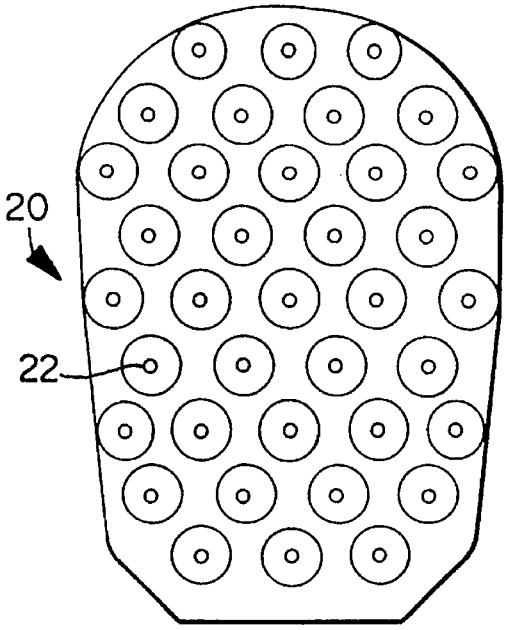
FIG. 2 is an exploded view of the cleaning plate depicting small holes for the brush bristles and the hand-operated attachment means.

With reference to FIG. 2, a cleaning plate 20 contains holes 22 through which bristles 16 can extend. It will be appreciated that when cleaning plate 20 is placed on top of bristles 16, the plate will travel down said bristles and rest generally at the base of the bristles proximate to the bristle holding surface 18.

Figure 4:
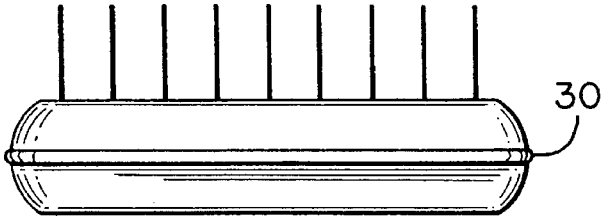
FIG. 4 shows a side view of the brush head indicating the preferred ridge section for releasable attachment of the cleaning plate.

With reference to FIG. 2, a cross-section of the cleaning plate 20 is shown, revealing a means 24 for releasably engaging said cleaning plate to the hair brush. As illustrated, said engaging means 24 is preferably a rounded edge or any other type of geometry which will generally surround or contact the brush and remain in tension with the brush thereby releasably engaging the cleaning plate to the brush body. In this regard, shown at 26 on the lower edge of the engaging means 24, is a raised edge of the type which allows for the cleaning plate to clip onto the brush, and in this regard it will be appreciated that the brush body itself may optionally contain a modification to the surface or edge opposite the bristles to accommodate raised edge 26 so that the cleaning plate clips or attaches more efficiently to the brush body. In a particular preferred embodiment, as shown in FIG. 4 the edges of the brush body contain a ridge 30 which provides a site for releasable attachment of the cleaning plate.

Figure 3:
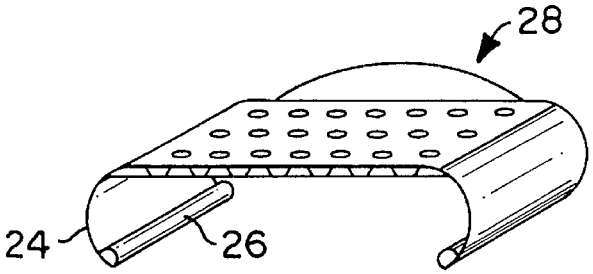
FIG. 3 is a side view of the cleaning plate of FIG. 2 showing a means for releasably engaging said cleaning plate from the brush.

Furthermore, and again with specific reference to FIG. 3, shown at 28 is a substantially semi-circular protruding edge of the cleaning plate which provides a hand-operated means for detaching said cleaning plate from the brush when the user desires to remove the cleaning plate and clean the brush. In the preferred example shown in FIG. 3, the hand-operated means 28 of the cleaning plate, when placed on the brush, provides a small slot or opening for the user to insert the thumb whereupon the cleaning plate will be disengaged from the brush and easily removed for the cleaning operation.

Finally, in an even more preferred embodiment, the holes 22 of the cleaning plate are cone shaped; i.e., they contain a larger opening on that side of the plate that contacts the brush head, as opposed to the other side which faces the bristles. In this regard, the cleaning plate can be more readily placed on and off of the bristles, in the cleaning procedure.

Modifications of the invention herein described will occur to those skilled in the art and all such modifications are deemed to be within the spirit and scope of the invention as defined in the following claims.

What is claimed is:

1. A hair brush having a cleaning feature which can be releasably attached to the brush comprising a base section having a multiplicity of parallel bristles extending from a bristle-holding surface thereof, a cleaning plate with two sides one side disposed on said bristle-holding surface and one side facing said bristles when in a first position and having holes through which the parallel bristles extend, said cleaning plate containing a hand-operated means for releasably engaging said cleaning plate from said base section for cleaning purposes, wherein the hand-operated means for releasably engaging said cleaning plate from said base section comprises a four-edge cleaning plate containing a top and bottom edge, the bottom edge configured to be disposed adjacent an end of said base section when the cleaning plate is in the first position and two side edges, including a protrusion on said bottom edge of said cleaning plate characterized in that the protrusion provides a raised edge on the cleaning plate when said cleaning plate is disposed on the base section of the bristles of the brush, and a means for engaging said cleaning plate to said brush base on the two side edges of the plate.

2. The hair brush of claim 1 wherein the means for engaging said cleaning plate to said base section comprises a substantially circumferentially rounded edge at each of the two sides edges of the plate that releasably engages the base section of the hair brush, opposite to the bristle holding surface.

3. The hair brush of claim 2, wherein the base section of the hair brush contains a ridge for releasably engaging the cleaning plate.

4. The hair brush of claim 1 wherein the holes of the cleaning plate are larger on that side of the cleaning plate disposed on the bristle holding surface, than on that side of the cleaning plate that face the bristles.

* * * * *